US010047488B2

(12) United States Patent
Leonhardt

(10) Patent No.: US 10,047,488 B2
(45) Date of Patent: Aug. 14, 2018

(54) FRANGIBLE POST FOR HIGHWAY BARRIER END TERMINALS

(71) Applicant: Patrick A. Leonhardt, Rocklin, CA (US)

(72) Inventor: Patrick A. Leonhardt, Rocklin, CA (US)

(73) Assignee: ENERGY ABSORPTION SYSTEMS, INC., Dallas, TX (US)

( * ) Notice: Subject to any disclaimer, the term of this patent is extended or adjusted under 35 U.S.C. 154(b) by 468 days.

(21) Appl. No.: 14/059,704

(22) Filed: Oct. 22, 2013

(65) Prior Publication Data

US 2014/0110652 A1 Apr. 24, 2014

Related U.S. Application Data

(60) Provisional application No. 61/774,209, filed on Mar. 7, 2013, provisional application No. 61/717,736, filed on Oct. 24, 2012.

(51) Int. Cl.

| | |
|---|---|
| ***E01F 15/02*** | (2006.01) |
| ***E01F 15/04*** | (2006.01) |
| ***E01F 15/14*** | (2006.01) |

(52) U.S. Cl.

CPC ..... *E01F 15/02* (2013.01); *E01F 15/0461* (2013.01); *E01F 15/143* (2013.01)

(58) Field of Classification Search

CPC ..... Y10T 403/11; E01F 9/018; E01F 9/0182; E01F 15/0461; E01F 15/146

See application file for complete search history.

(56) References Cited

U.S. PATENT DOCUMENTS

| | | | |
|---|---|---|---|
| 4,330,106 | A | 5/1982 | Chisholm |
| 4,838,523 | A | 6/1989 | Humble et al. |
| 4,928,928 | A | 5/1990 | Buth et al. |
| 5,503,495 | A | 4/1996 | Mak et al. |
| 5,664,905 | A | 9/1997 | Thompson et al. |
| 5,775,675 | A | 7/1998 | Sicking et al. |
| 5,855,443 | A | 1/1999 | Faller et al. |
| 5,967,497 | A | 10/1999 | Denman et al. |
| 6,065,738 | A | 5/2000 | Pearce et al. |

(Continued)

FOREIGN PATENT DOCUMENTS

| | | |
|---|---|---|
| EP | 0 924 347 A1 | 6/1999 |
| IT | 1383506 B | 12/2010 |
| IT | AN2011A00004 | 1/2011 |

OTHER PUBLICATIONS

International Search Report issued in corresponding PCT Patent Application No. PCT/US2013/066118, dated Apr. 16, 2014, 2 pages.

Alberson, Dean C. et al., "A Review of Cable/Wire Rope Barrier Design Considerations," Transportation Research Board 2003 Annual Meeting, Transportation Research Board, Washington D.C., 2003, 25 pages.

(Continued)

*Primary Examiner* — Matthieu F Setliff

(74) *Attorney, Agent, or Firm* — Brinks Gilson & Lione

(57) ABSTRACT

A frangible post captures and holds a cable anchor to a guardrail. The post breaks when struck by a vehicle, releasing the cable. The frangible post may include hinge members, which bias the post so that weakened sections are put in tension when the post is struck, thereby ensuring that the post breaks cleanly and the cable is released when the post is struck. A method of releasing a cable anchor includes impacting the post, biasing the weakened sections so that they are in tension, breaking the post, and releasing the cable anchor. The post may be configured with a notch to engage the cable anchor, which is then released from the notch as the post is broken.

26 Claims, 2 Drawing Sheets

(56) References Cited

U.S. PATENT DOCUMENTS

| | | | |
|---|---|---|---|
| 6,065,894 | A | 5/2000 | Wasson et al. |
| 6,142,452 | A | 11/2000 | Denman et al. |
| 6,210,066 | B1 | 4/2001 | Dent |
| 6,254,063 | B1 | 7/2001 | Rohde et al. |
| 6,264,162 | B1 | 7/2001 | Barnes et al. |
| 6,398,192 | B1 | 6/2002 | Albritton |
| 6,409,156 | B2 | 6/2002 | Dent |
| 6,488,268 | B1 | 12/2002 | Albritton |
| 6,505,820 | B2 | 1/2003 | Sicking et al. |
| 6,619,630 | B2 | 9/2003 | Albritton |
| 6,729,607 | B2 | 5/2004 | Alberson et al. |
| 6,793,204 | B2 | 9/2004 | Albritton |
| 6,886,813 | B2 | 5/2005 | Albritton |
| 6,902,150 | B2 | 6/2005 | Alberson et al. |
| 6,932,327 | B2 | 8/2005 | Alberson et al. |
| 7,367,549 | B2 | 5/2008 | Titmus |
| 8,177,194 | B2 | 5/2012 | James |
| 8,215,619 | B2 | 7/2012 | Leonhardt et al. |
| 2002/0030183 | A1 | 3/2002 | Albritton |
| 2006/0027797 | A1 | 2/2006 | Sicking et al. |
| 2006/0038164 | A1 | 2/2006 | Sicking et al. |
| 2010/0192482 | A1 | 8/2010 | James |
| 2012/0056143 | A1 | 3/2012 | James |
| 2012/0199802 | A1 | 8/2012 | James |

OTHER PUBLICATIONS

Bielenberg, Robert W. et al., "Development of the Universal Breakaway Steel Post for the Bullnose Median Barrier," Transportation Research Board 2012 Annual Meeting, Transportation Research Board, Washington D.C., 2012, 21 pages.

Hitz, Rebecca A. et al., "Design and Evaluation of a Low-Tension Cable Guardrail End Terminal System," Final Report to the Midwest States' Regional Pooled Fund Program MwRSF Research Report No. TRP-03-131-08, Midwest Roadside Safety Facility, University of Nebraska-Lincoln, Jul. 15, 2008, 251 pages.

Schmidt, Jennifer D. et al., "Investigating the Use of a New Universal Breakaway Steel Post—Phase 3," Midwest Roadside Safety Facility, University of Nebraska-Lincoln and Midwest States Regional Pooled Fund Program, Nebraska Department of Roads, MwRSF Research Report No. TRP-03-244-10, Dec. 16, 2010, 139 pages.

Sicking, Dean L. et al., "Design and Development of Steel Breakaway Posts," Transportation Research Record 1720, Paper No. 00-628, Transportation Research Board, National Research Council, Washington D.C., 2000, 22 pages.

Correspondence from John R. Baxter, P.E., Director, Office of Safety Design, Office of Safety, U.S. Department of Transportation, Federal Highway Administration, Washington, D.C., to Mr. Kaddo Kothmann, President, Road Systems, Incorporated, Big Spring, Texas, dated Mar. 8, 2005, with enclosures, 9 pages.

10
11
1
2
4
5
6
7
8
20
21
22
23
24
T
C

FRANGIBLE POST FOR HIGHWAY BARRIER END TERMINALS

This application claims the benefit of U.S. Provisional Application No. 61/774,209, filed Mar. 7, 2013, and also claims benefit of U.S. Provisional Application No. 61/717,736, filed Oct. 24, 2012, the entire disclosures of which are hereby incorporated herein by reference.

TECHNICAL FIELD

The present invention relates generally to a frangible post used in a guardrail system.

BACKGROUND

Guardrails have been used for many years on our nation's highways to protected errant motorists from hazards alongside the roadway. Guardrails function by capturing errant vehicles and redirecting them away from the hazard. Hazards that are commonly protected by guardrails include trees, signs, culverts, bridge piers, steep edge drop-offs, and soft soil that could cause vehicle roll.

Guardrails are able to capture an errant vehicle by having the longitudinal strength to resist the vehicle impact. This means that the steel rail and its joints are stronger that the forces generated during the vehicle impact. The steel rail is held in place by either wood or steel posts. The posts hold the rail at the proper height and are designed to bend over and fail during an impact. These posts are individually relatively weak, however when taken as a system, they are able to resist the lateral loads imposed upon the rail. Additional structural strength is often provided to the rail by anchoring each end of the rail, either through the use of a crashworthy end terminal, or some other means of fixing the end of the steel rail to the ground.

Many end terminal designs, such as the design disclosed by Buth in U.S. Pat. No. 4,928,928, make use of an anchor cable. The anchor cable is attached on one end to the last section of guardrail and on the other end the cable is captured by a post at ground level. In this way, longitudinal forces that the rail experiences during a vehicle impact are transmitted through the cable to the ground via the post.

Although this arrangement provides an anchorage for the guardrail when it is hit downstream of the end, it also tends to make the guardrail more rigid if it is struck on the end, which may not be desirable in axial impacts. In response, some end terminal designs incorporate a breakaway post, which releases the cable if the terminal is hit on the end. Examples of posts that work in this way may be found in Buth, as well as U.S. Pat. No. 6,619,630 to Albritton, U.S. Pat. No. 5,967,497 to Denman, and US 2012/0056143 to James. The Buth and Denman devices make use of wood posts which have been weakened by placing a large hole in the center. The cable passes through and is captured by this hole. In this way the cable is restrained by the post, but if the post is broken off during an axial impact direction hit, the cable is released. Since wood has little ductility, the Buth and Denman devices fracture readily, releasing the cable, thereby reducing the possibility that the posts will retain the cable as the vehicle passes over the top.

Albritton discloses a steel break-away post that rotates around two hinge bolts during an impact. This rotation shears two frangible bolts, releasing the top half of the post, from the bottom half of the post. Although the Albritton device provides an anchorage to downstream rail impacts, while readily releasing during axial impact direction impacts, it is relatively expensive to manufacturing and requires numerous parts to be shaped and then welded together.

The device disclosed in James makes use of a single post that is modified to promote fracture. The post is modified by adding a central hole in the web and by notching the sides of the post below where the cable is attached. The James device also includes a slotted cable bracket that is welded above the central hole. Although the James device includes weakened sections to promote failure of the post, there is no guarantee that the post will actually fracture. Instead, depending upon the material used, the post may yield at the weakened sections and bend over. This is especially true if ductile materials, such as steel or aluminum are used. Indeed, James sized the central cutout of the post in such a way that the cable could pass through the post, once the post had yielded and released the cable. In this way, the James device does not rely on failure of the post to release the cable, but instead relies on the cable passing through the aperture in the post. The cable, however, may become caught on the post, rather than passing through the post, as intended.

Although adding holes and slots to posts to weaken them is well known in the art, such posts, if made of a ductile material, may tend to bend at the point of weakening, rather than break. As such, a portion of the post may remain and continue to bind the top and bottom portions of the post together.

SUMMARY

Briefly stated, in one aspect, one embodiment of a guardrail anchor includes a frangible post having a cable anchor adapted to capture and hold an anchor cable. The one-piece frangible post is breakable from an intact anchor configuration to a releasable configuration during an axial impact. The frangible post includes completely separated upper and lower portions when in the releasable configuration. A laterally extending hinge member extends through a hinge opening. The frangible post experiences tension forces upstream of the hinge opening and compression forces downstream of the hinge opening during the axial impact.

In one embodiment, a frangible post includes an elongated member having a hinge opening, a hinge member extending through the hinge opening, and a zone of weakness positioned upstream of the hinge opening. The elongated member is moveable between an intact configuration to a releasable configuration in response to an impact applied transversely to the elongated member. A compressive force is applied to the hinge member and a tensile force is applied to the zone of weakness as the elongated post is moved from the intact configuration to the releasable configuration. The elongated member is completely separated into upper and lower portions when in the releasable configuration.

In another aspect, a method of breaking a guardrail post includes applying an impact force to an upper portion of a post from a vehicle traveling in a longitudinal direction, applying a compressive force to a hinge member with the post, and applying a tensile force to a zone of weakness formed in the post upstream of the hinge member and thereby completely separating the upper portion of the post from a lower portion of the post.

In one embodiment, the one piece frangible post is used solely to support portions of a cable barrier, a guardrail, a cable barrier end terminal, or a guardrail end terminal. In this embodiment the one piece post may or may not have a central hole for an anchor cable, or be affixed to an anchor cable bearing plate.

In yet another aspect, a bearing plate is engaged with the post and transfers loading from the cable to the first post. The bearing plate is releasably held by the upper portion of the post such that when the upper portion is broken off, the bearing plate is pulled upwards away from the bottom portion of the post to prevent snagging. The bearing plate is then released from the top post.

The present embodiments of the invention, together with further objects and advantages, will be best understood by reference to the following detailed description taken in conjunction with the accompanying drawings.

DETAILED DESCRIPTION OF THE PRESENTLY PREFERRED EMBODIMENTS

It should be understood that the term "longitudinal," as used herein means of or relating to length or the lengthwise direction of a guardrail, which is parallel to and defines an "axial impact direction." The term "lateral," as used herein, means directed toward or running perpendicular to the side of the guardrail. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" rail sections may refer to any sequence of such sections, and is not limited to the first and second upstream rail sections unless otherwise specified. The term "frangible," as used herein means to break or separate into two or more pieces. The term "yield" means to bend or deform, without breaking. The term "ductile" refers to a material that can yield substantially, e.g., bend 45 degrees or more, without breaking. The term "downstream," as used herein refers to the direction with the flow of traffic that is adjacent an end terminal or guardrail, whereas the term "upstream" means in a direction against or opposite the flow of traffic. The term "plurality" means two or more, or more than one. The term "upstream" refers to a longitudinal direction closer to the impact end of the guardrail, while the term "downstream" refers to a longitudinal direction further away from the impact end.

Figures 1, 2, 3, 4, 5A, 5B:
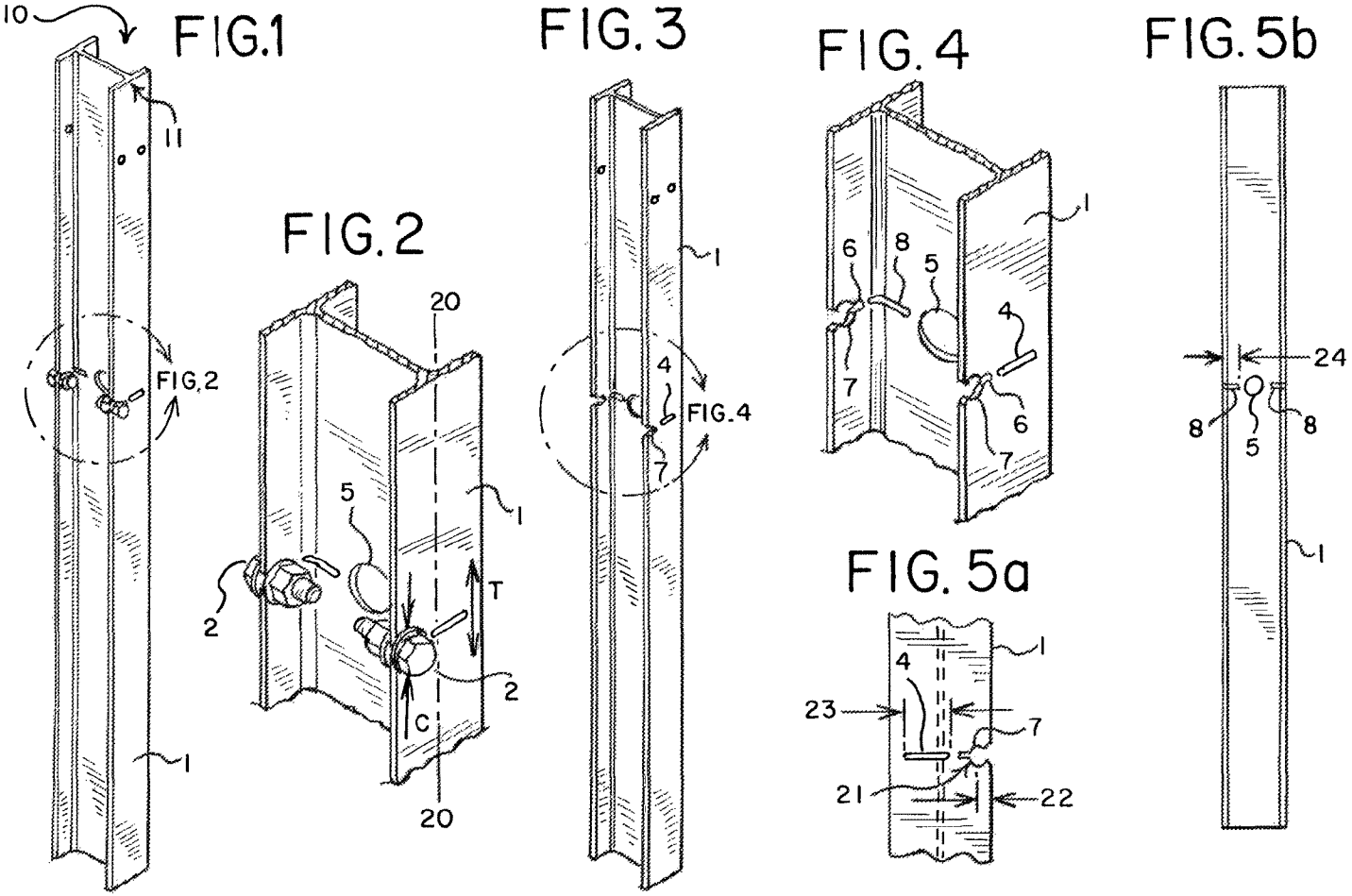
FIG. 1 is a perspective view of a frangible post configured with hinge bolts.
FIG. 2 is an enlarged view of the frangible post of FIG. 1 taken along line 2.
FIG. 3 is a perspective view of a frangible post configured without hinge bolts.
FIG. 4 is an enlarged view of the frangible post of FIG. 3 taken along line 4.
FIG. 5*a* is a side view of the post shown in FIGS. 3 and 4.
FIG. 5*b* is a front view of the post shown in FIGS. 3 and 4.

FIG. 1 shows one embodiment of a frangible post 1 consists of an "I" section post conforming to the ASTM W6x8.5 specification. In one embodiment, the frangible post 1 is made of a ductile material such as ASTM A-36 steel, although other steels, ductile cast irons, or other appropriate materials could be used. It should be understood that larger or smaller "I" sections could be used in various applications of this invention, as well as "C" channel posts, square tube posts, Σ (Sigma) Post sections or other post shapes. FIG. 1 also shows axial and lateral impact directions 10 and 11, which are orthogonal to each other. Axial impact direction 10 is typically oriented in such a way that frangible post 1 will break and release.

FIG. 2 is a detail view of the center section of frangible post 1 showing the midpoint of the post, which is near ground level when the post is installed. Also shown in FIG. 2 are the hinge bolts 2, which in this embodiment consist of a bolt with two flat washers, a lock washer and a nut. Although two hinge bolts are shown in FIG. 2, other types or combinations of fasteners could be used. For instance, one long fastener could be used which passes through both sides of the post and is affixed with a nut on the far side. Likewise, permanent rivets, pins, other similar fasteners could be used. Frangible post 1 has been modified to allow the installation of hinge bolts 2 and FIG. 4 is a detail of the post with the hinge bolts removed.

As FIG. 4 shows, the modifications required for the post include a central hole 5, side slots 4 and 6, hinge bolt holes 7, central slots 8, and central hole 5. The hinge bolt holes 7, and hinge bolts 2, otherwise referred to as hinge members, are located on the downstream side of the post, such that the post imparts a compression force to the bolts 2 during an axial impact. In one embodiment, there is no material joining upper and lower portions of the posts downstream of the hinge bolt holes. The side slots 4 and central slots may be contiguous, or separate. The side slots, central hole and/or central slots form and define a zone or line of weakness, which features are positioned and sized to promote fracture of the post, as it hinges around hinge bolts 2. For example, in one embodiment, the hinge bolt holes 7 are located downstream of a midline of the post, represented by the central web of the post 1, as shown for example in FIGS. 4 and 5*a*. Although slots and round holes are shown in FIG. 4, it should also be understood that other combinations of geometric hole features could be used, for instance square holes, a series of round holes or like perforations, and/or square and round slots. Other weakening features could also be used to form a zone or line of weakness, such as crimping the post or selectively heat treating portions of the post by welding, flame treating, or other such processes. These features could be located away from the edges of the post, as is shown in FIG. 4, or they could also be located at the edges of the post.

FIGS. 5*a* and 5*b* show a configuration of side slots 4 and hinge bolt holes 7. Distance 23 is the length of side slot 4, measurement 21 is the diameter of hinge bolt hole 7 and distance 22 is the distance of hinge bolt hole 22 to the edge of frangible post 1. These dimensions can be modified to change the force required to cause frangible post 1 to fail. For instance, shortening the length of distance 23 of side slot 4 will leave more post material remaining and a higher load will be required to cause frangible post 1 to fail. In a similar fashion, dimension 21, which is the diameter of hinge bolt hole 7, as well as dimension 22, which is the distance from the center of the hinge bolt hole 7 to the edge of the part, can be made larger or smaller to accommodate different sized hinge bolts 2.

FIG. 5*b* shows dimension 24, which is the length of the center slots 8. In the same way as was disclosed earlier, dimension 24 can be changed to modify the way that the post performs for certain post designs. For instance, dimension 24 for center slot 8 on one side of the post can be longer than the corresponding dimension for the center slot on the other side of the post. In this way, frangible post 1 can be made directional, with better performance in oblique impacts, which are at some angle to impact direction 10. In a similar fashion, dimension 24 for the central slots 8 can be tuned with dimension 23 of the side slots 4 in such a way as to change the strength of the post in direction 10, as opposed to direction 11.

Figure 6:
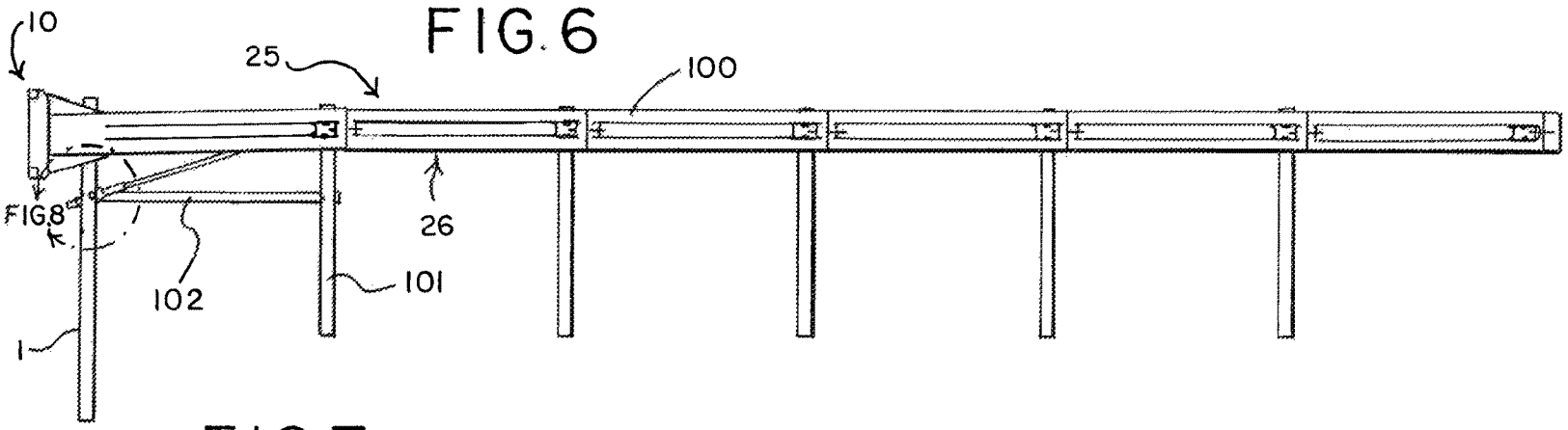
FIG. 6 is a side view of a guardrail assembly incorporating a frangible post.

FIG. 6 is a side view of a guardrail end terminal 25 that includes frangible post 1. In this instance, the guardrail end terminal 25 may be configured as a TREND™ End Terminal manufactured by Trinity Highway Products LLC. Further details on the TREND may be found, for example and without limitation, in U.S. Pat. No. 8,215,619, which is hereby incorporated herein by reference. It should be understood that frangible post 1 could also be used in other end terminals, guardrails, or cable barrier systems, such as disclosed in U.S. Pat. No. 4,928,928, U.S. Pat. No. 5,967,497, or U.S. Pat. No. 6,932,327, all of which are hereby incorporated herein in by reference. FIG. 6 also shows the axial impact direction 10 corresponding to an axial impact with the end terminal including frangible post 1. FIG. 6 also shows the ground level 26, which corresponds in one embodiment to the approximate level of the side slots 4, 6, the central slots 8, and the hinge bolts 2. It should be understood that the actual location of the ground level 26 in relation to these features could be lower or higher in some embodiments. It should also be understood that frangible post 1 could be used in place of other system posts, including those supporting the downstream guardrail. In these instances, frangible post 1 would not need central hole 5 and the center slots 8 could be lengthened and/or joined.

Figure 7:
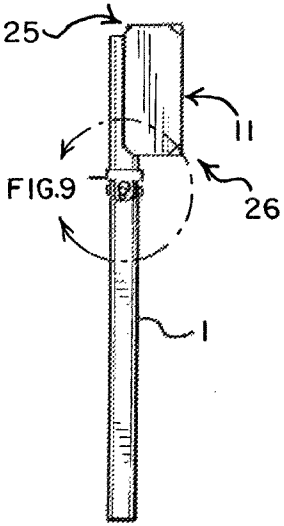
FIG. 7 is a front view of the guardrail assembly shown in FIG. 6.

FIG. 7 is a front view of guardrail end terminal 7 showing frangible post 1 and impact direction 11, which corresponds to a lateral impact of guardrail end terminal 25.

Figure 8:
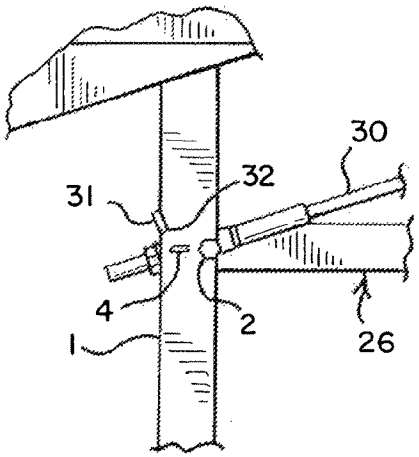
FIG. 8 is an enlarged, partial view of the frangible post in the guardrail assembly of FIG. 7, taken along line 8.
Figure 9:
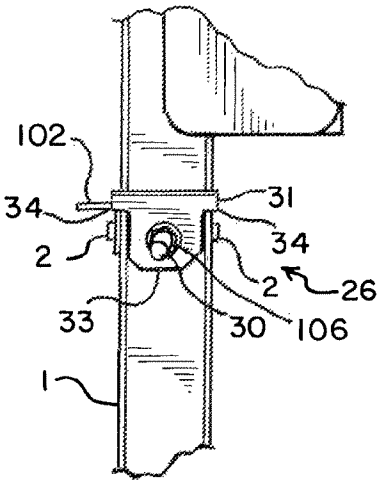
FIG. 9 is a front view of the frangible post and assembly shown in FIG. 8.

FIGS. 8 and 9 correspond to enlarged side and front views of frangible post 1 when it is used as the first post of guardrail end terminal 25. As shown in FIG. 8, frangible post 1 includes a cable anchor that captures and provides anchorage to anchor cable 30. As shown in FIGS. 8 and 9, anchor cable 30 is held in place by bearing plate 31, which serves as the cable anchor. In this embodiment, bearing plate 31 is formed in a "T" shape, with the middle portion 33 of the bearing plate 31 resting against the central web of frangible post 1. The two arms 34 of the bearing plate 31 rest in notches 32 cut in frangible post 1, which are located above the location where the post fails during an impact. The notches include a shelf portion and a wall portion, with the wall portion lying at an acute angle $\alpha$ relative to a vertical axis, and with the wall portion and shelf portion forming a right angle in one embodiment. The bearing plate 31 transfers loading from the cable 30 to the first post 1. The bearing plate is designed to be releasably held in the notch by the upper portion of the post 1 in such a way that when the upper portion is broken off or completely severed from the lower portion, the bearing plate 31 is pulled upwards away from the bottom portion of the post by way of engagement with the notch 32 to prevent snagging. The bearing plate is then released from the top post. It should be understood that the cable may be secured to the post through other cable anchor devices and mechanisms.

In operation, the posts of guardrail and cable barrier end terminals must serve dual purposes. During axial impact direction impacts with the terminal, the posts must easily break away, allowing the errant vehicle to penetrate the system without causing excessive damage to the vehicle. Furthermore, in some systems the first post 1 of the system must also release the cable anchorage, e.g. bearing plate 31, which likewise will prevent appreciable tension being formed in the guardrail itself. However during lateral impacts with the end terminal or its downstream rail or cable, the cable anchorage of the end terminal must be held fast by the first post 1 with the tensile force developed in the rail or cable 30 being transferred to the ground through the first post 1.

In one embodiment, the frangible post 1 reliably resists the tension formed in the anchor cable 30 during redirective impacts and readily breaks away, releasing the cable during axial impact direction impacts. The releasable hinge member 2 takes the compressive loading of the post, forcing all of the remaining post material into tension, thereby causing the remaining material to tear, for example along the zone of weakness. However, once the remaining post material has torn completely through, the releasable hinge member 2 does not provide any appreciable joining force and the upper and lower portions of the post are allowed to easily separate, releasing the cable anchor. As referenced above, the bearing plate is initially pulled upwardly by the notch of the upper portion and then released as the upper portion separates from the lower portion. In this way, the frangible post is breakable from an intact anchor configuration to a releasable configuration during an axial impact, wherein the frangible post is broken into completely separate upper and lower portions when in the releasable configuration.

There may be some spacing between the hinge member and the hole in an initial intact anchor configuration, for example due to tolerances. In such a case, during the beginning of an axial impact, the post follows classical beam bending, i.e. tension upstream of the neutral axis and compression downstream. The material in tension stretches, then yields, and then fails. This moves the neutral axis downstream, bringing new material into tension. At the same time the material in compression closes any spacing between the post and the hinge member at the hinge hole, causing the hinge member to be compressed. As more and more of the material in tension fails, the neutral axis moves further downstream, until at some point all of the remaining post material is in tension and the hinge member takes all of the compressive load. The remaining post material then fails, releasing the upper portion of the post.

The frangible post may be used solely to support portions of a cable barrier, a guardrail, a cable barrier end terminal, or a guardrail end terminal. In one embodiment, the one piece post may not have a central hole for an anchor cable, or be affixed to an anchor cable bearing plate.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A guardrail anchor comprising:

a one-piece, monolithic frangible post comprising a cable anchor adapted to capture and hold an anchor cable, wherein the one-piece, monolithic frangible post is breakable from an intact anchor configuration to a releasable configuration during an axial impact, wherein the one-piece, monolithic frangible post comprises completely separated upper and lower portions when in the releasable configuration; and wherein the one-piece frangible post comprises a laterally extending hinge member extending through a hinge opening formed in the one-piece, monolithic frangible post, wherein the one-piece, monolithic frangible post experiences tension forces upstream of the hinge opening and compression forces at the hinge member during the axial impact.

2. The guardrail anchor of claim 1 wherein the hinge opening is positioned downstream of a midline of the one-piece, monolithic frangible post.

3. The guardrail anchor of claim 1 wherein there is no material joining the upper and lower portions of the one-piece, monolithic frangible post downstream of the hinge opening.

4. The guardrail anchor of claim 1 wherein the one-piece, monolithic frangible post comprises a laterally extending web having an opening formed therethrough, and an anchor cable extending through the opening.

5. The guardrail anchor of claim 4 further comprising a bearing plate secured to the anchor cable.

6. The guardrail anchor of claim 5 wherein the one-piece, monolithic frangible post further comprises a notch positioned in the upper portion, wherein the bearing plate is disposed in and engaged by the notch, and wherein the bearing plate is releasable from the notch during the impact.

7. The guardrail anchor of claim 1 wherein the one-piece, monolithic frangible post further comprises a zone of weakness positioned upstream of the hinge opening.

8. The guardrail anchor of claim 7 wherein the zone of weakness comprises a first opening formed in the one-piece, monolithic frangible post.

9. The guardrail anchor of claim 8 wherein the first opening comprises a slot formed in a side flange of the one-piece, monolithic frangible post.

10. The guardrail anchor of claim 8 wherein the zone of weakness comprises a second opening formed in a laterally extending flange of the one-piece, monolithic frangible post.

11. The guardrail anchor of claim 10 wherein the second opening comprises a slot.

12. The guardrail anchor of claim 1 wherein the upper and lower portions of the one-piece, monolithic frangible post have a uniform cross-sectional profile extending along a length of the one-piece, monolithic frangible post when the one-piece, monolithic frangible post is in the intact anchor configuration.

13. A frangible post comprising:

a one-piece, monolithic frangible elongated member comprising a hinge opening positioned at a junction between upper and lower portions of the one-piece, monolithic frangible elongated member, a hinge member extending through the hinge opening, and a zone of weakness positioned upstream of the hinge opening, wherein the one-piece, monolithic frangible elongated member is breakable between an intact configuration to a releasable configuration in response to an impact applied transversely to the one-piece, monolithic frangible elongated member, wherein a compressive force is applied to the hinge member and a tensile force is applied to the zone of weakness as the one-piece, monolithic frangible elongated member is moved from the intact configuration to the releasable configuration, and wherein the upper and lower portions are completely separated when the one-piece, monolithic frangible elongated member is in the releasable configuration.

14. The frangible post of claim 13 wherein the hinge opening is positioned downstream of a vertical midline of the one-piece, monolithic frangible elongated member.

15. The frangible post of claim 13 wherein there is no material joining the upper and lower portions of the one-piece, monolithic frangible elongated member downstream of the hinge opening.

16. The frangible post of claim 13 wherein the zone of weakness comprises a first opening formed in the one-piece, monolithic frangible elongated member.

17. The frangible post of claim 16 wherein the first opening comprises a slot formed in a side flange of the one-piece, monolithic frangible elongated member.

18. The frangible post of claim 16 wherein the zone of weakness comprises a second opening formed in a laterally extending flange of the one-piece, monolithic frangible elongated member.

19. The frangible post of claim 18 wherein the second opening comprises a slot.

20. The frangible post of claim 13 wherein the one-piece, monolithic frangible elongated member further comprises a notch positioned in the upper portion, wherein the notch is adapted to engage a bearing plate secured to an anchor cable.

21. The frangible post of claim 13 wherein the upper and lower portions of the one-piece, monolithic frangible elongated member have a uniform cross-sectional profile extending along a length of the one-piece, monolithic frangible elongated member when the one-piece, monolithic frangible elongated member is in the intact configuration.

22. A guardrail anchor comprising:

a one-piece, monolithic frangible post comprising a cable anchor adapted to capture and hold an anchor cable, wherein the one-piece, monolithic frangible post is breakable from an intact anchor configuration to a releasable configuration during an axial impact, wherein the one-piece, monolithic frangible post comprises completely separated upper and lower portions when in the releasable configuration, and wherein the upper portion comprises a notch engaging the cable anchor, wherein the cable anchor is releasable from the notch when the one-piece, monolithic frangible post is in the releasable configuration.

23. The guardrail anchor of claim 22 wherein the cable anchor comprises a bearing plate.

24. The guardrail anchor of claim 23 wherein the one-piece, monolithic frangible post comprises a pair of laterally spaced notches, and the bearing plate comprises a pair of arms disposed in the notches.

25. The guardrail anchor of claim 22 wherein the notch is formed on an upstream edge of the one-piece, monolithic frangible post and includes a shelf portion and a wall portion, wherein the wall portion defines an acute angle relative to a vertical axis.

26. The guardrail anchor of claim 22 wherein the upper and lower portions of the one-piece, monolithic frangible post have a uniform cross-sectional profile extending along a length of the one-piece frangible post when the one-piece, monolithic frangible post is in the intact anchor configuration.

* * * * *